United States Patent [19]

Harold

[11] Patent Number: 4,801,374

[45] Date of Patent: Jan. 31, 1989

[54] APPARATUS FOR THE TREATMENT OF SEED MATERIALS

[75] Inventor: Franz Harold, Hintersdorf, Austria

[73] Assignee: Maschinenfabrik Heid Aktiengesellschaft, Stockerau, Austria

[21] Appl. No.: 68,011

[22] Filed: Jun. 29, 1987

[30] Foreign Application Priority Data

Jun. 27, 1986 [AT] Austria ..... 1749/86

[51] Int. Cl.[4] ..... B07B 4/02

[52] U.S. Cl. ..... 209/135; 209/31; 209/33

[58] Field of Search ..... 209/140–143, 209/146, 148, 133, 132, 12, 21, 30, 31–35

[56] References Cited

U.S. PATENT DOCUMENTS

| | | | |
|---|---|---|---|
| 27,171 | 2/1860 | Trimmer | 209/35 |
| 760,852 | 5/1904 | Williamson | 209/33 |
| 2,325,080 | 7/1943 | Stephanoff | 209/143 |
| 3,252,663 | 5/1966 | Kidwell | 209/143 |
| 3,378,140 | 4/1968 | Wochnowski et al. | 209/143 |
| 3,572,503 | 3/1971 | Hezel | 209/135 |
| 3,643,797 | 2/1972 | Berkowitz et al. | 209/135 |
| 3,856,217 | 12/1974 | Brewer | 209/135 |
| 4,490,247 | 12/1984 | Forsberg et al. | 209/135 |

FOREIGN PATENT DOCUMENTS

| | | | |
|---|---|---|---|
| 537987 | 7/1921 | France | 209/35 |
| 739594 | 11/1932 | France | 209/155 |
| 473532 | 9/1975 | U.S.S.R. | 209/136 |

*Primary Examiner*—Johnny D. Cherry
*Assistant Examiner*—Donald T. Hajec
*Attorney, Agent, or Firm*—Herbert Dubno

[57] ABSTRACT

Seed materials are presorted by directing a stream of air across a cascade of the materials into heavy, mixed and light fractions and only the mixed fraction is then subjected to the usual gamut and further sorting and classifying operations. The heavy fraction consists predominantly of good seed which does not require such futher processing.

3 Claims, 2 Drawing Sheets

APPARATUS FOR THE TREATMENT OF SEED MATERIALS

FIELD OF THE INVENTION

My present invention relates to the treatment of seed materials, namely, mixtures of seeds and other materials which are associated with the raw product and which must be subjected to a separation of the seed kernels or grains from the materials which normally accompany them in the raw seed products. More particularly, the invention relates to a method of and to an apparatus for the treatment of such seed materials whereby the seed grains can be separated from light components such as straw, chaff and weeds and can be sorted in accordance with grain width and grain thickness, grain length and grain weight.

BACKGROUND OF THE INVENTION

The treatment or processing of such seed materials has been effected heretofore generally in a chain of machines in each of which, one or more separating processes can be carried out so that impurties can be separated from the seed grains and seeds having a poor germinating capability or which are incapable of germination can be removed from those seed grains with the greatest propensity to germination.

Thus it is known in a first step, to carry out e.g. a pneumatic sifting to remove impurities such as straw, chaff and weeds by entrainment in a rising air column under suction from the seed materials and to then subject the seed product to a sifting operation using a variety of types of sieves to separate the seed grains in accordance with grain width and thickness.

Using a winnower or the like, separation is effected based upon length, and thus broken grains, long particles and the like can be separated from the seed product. The final seed separation can be effected in accordance with weight based upon the principle that good seed grains will have a limited range of weights while poor seed grains will have a different weight resulting, for example, from damage or hollows in seed grains. The weight separation can be effected in a fluidized bed utilizing weight-classification principles.

In U.S. Pat. No. 4,490,247, for example, a pneumatic sifter or classifier is provided which affords a separation of a mixture in a heavy and a light fraction utilizing a first oscillating conveyer to convey the material mixture counter to an upwardly directly air stream at the discharge end of the conveyer. A second oscillating conveyer is located at the level of the first or therebelow and the input end of the second conveyer can have an upwardly inclined portion onto which the heavy fraction from the discharge end of the first conveyer falls. The heavy fraction is thereby separated from the light fraction which is carried off by the air stream over the horizontal measure part of the second conveyer.

In U.S. Pat. No. 4,219,410, a method and apparatus for separating heavy metal particles from lighter chips are described. The chips which surround the heavy metal articles are moved along a conveyer path over a slit transverse to the conveyer direction. A gas stream is directed through the transverse slit to entrain the chips away form the heavy metal particles which fall through the slit.

Europatent publication No. 126 177 describes an apparatus for sorting granular products utilizing a column arrangement which is subdivided by sieves of different mesh size. A device is provided for generating an artificial airflow through the column so that the product to be sorted is entrained by the air stream through the sieves and is thus separated by size.

OBJECTS OF THE INVENTION

It is the principal object of the present invention to provide an improved method of and apparatus for the treatment of seed materials which will overcome the drawbacks of earlier systems and, in particular, allow a reduction in the size and number of the machines or stages to which the seed materials must be subject in order to obtain a given amount of desirable seed grains.

Another object of my invention is to provide an improved method of and apparatus for the presorting of seed materials which will simplify the sorting operation and make the latter more economical.

SUMMARY OF THE INVENTION

These objects and others which will become more readily apparent hereinafter are attained, in accordance with the present invention, in a method which comprises directing an air stream transversely to a cascade of the raw seed materials and collecting from the thus fanned-out cascade of said materials, a heavy fraction, an intermediate mixed fraction and a light fraction such that the heavy fraction consists of substantially 30 to 40% of the final good seed which is to be ultimately recovered. The heavy fraction can be used directly or subjected only to minimal further treatment while the intermediate fraction or mixed fraction may be subjected to the usual treatments described above utilizing, for example, a winnower and a weight classifier to recover the balance of the good seed therefrom. Thus only the intermediate fraction of the three fractions need the subject to the further treatments described. The good seed from the heavy fraction. and, of course, the mixed fraction can then be combined as the seed product. The light fraction can be discarded as a waste.

Because, in accordance with this invention, some 30 to 40% of the good seed is recovered without processing it through the winnower and weight classifier, i.e. is recovered immediately as usable seed product, it is possible to dimension the usual processing machines and equipment including the winnower and the weight classifier so as to handle much smaller throughputs and thereby increase the efficiency of the entire apparatus by about 50%.

The key to the invention in method terms, therefore, is the presorting operation which causes the fanning out of a cascade of the raw seed materials by directing thereagainst transversely to this cascade, a circulating air stream. The degree to which the seed grains are deflected from a straight line freefall will thus depend upon the specific gravity and surface shape of the seed and it is thus possible to collect the three fractions mentioned above such that the heavy fraction consists practically only of good seed, the mixed fraction contains practically all the balance of the good seed and practically no significant light component, while the light fraction is practically only waste.

The mixed fraction, as noted, is subjected to the usual process steps while the heavy fraction can be used directly or only with a minor degree of sifting being combined with the pure seed product obtained after processing of the mixed fraction through the usual processing line.

According to the apparatus aspect to this invention, the apparatus for carrying out the presorting comprises an annular channel formed of two opposite curved sections and two opposite straight sections. A cross-flow blower or axial blower is provided in this annular channel. Along the inner peripheral wall of this annular channel, the upstream of one of the curved sections and at the start of the latter an inlet slit is provided across the width of the channel for discharging a cascade of the raw seed materials across the flow cross-section of the channel. Directly opposite this inlet slit, the outer wall of the channel is formed, also over the width of the annular channel with an outlet opening for the seed materials.

According to a feature of the invention, the curved section of the annular channel immediately downstream of the inlet slit is formed with two segments of different radii and centers of curvature with the radii of curvature of the segment proximal to the inlet slit being greater than the radii of curvature of the segment more distal therefrom. This has been found to promote the desired fanning out of the seed material flow.

Preferably the blower is provided, in the flow direction, directly adjacent the end of the curved section of the annular channel at whose upstream side the inlet slit is provided. This affords a good distribution of the air stream over the cross section of the channel before it encounters the seed-material stream.

To remove the lightest components, for example, dust and chaff which may be entrained with the air stream, it has been found advantageous, in accordance with this invention, to provide along the outer wall of the annular channel at the downstream end of the other curved section a discharge device for removing a fraction of the circulated air and, of course, the dust and chaff entrained therewith.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
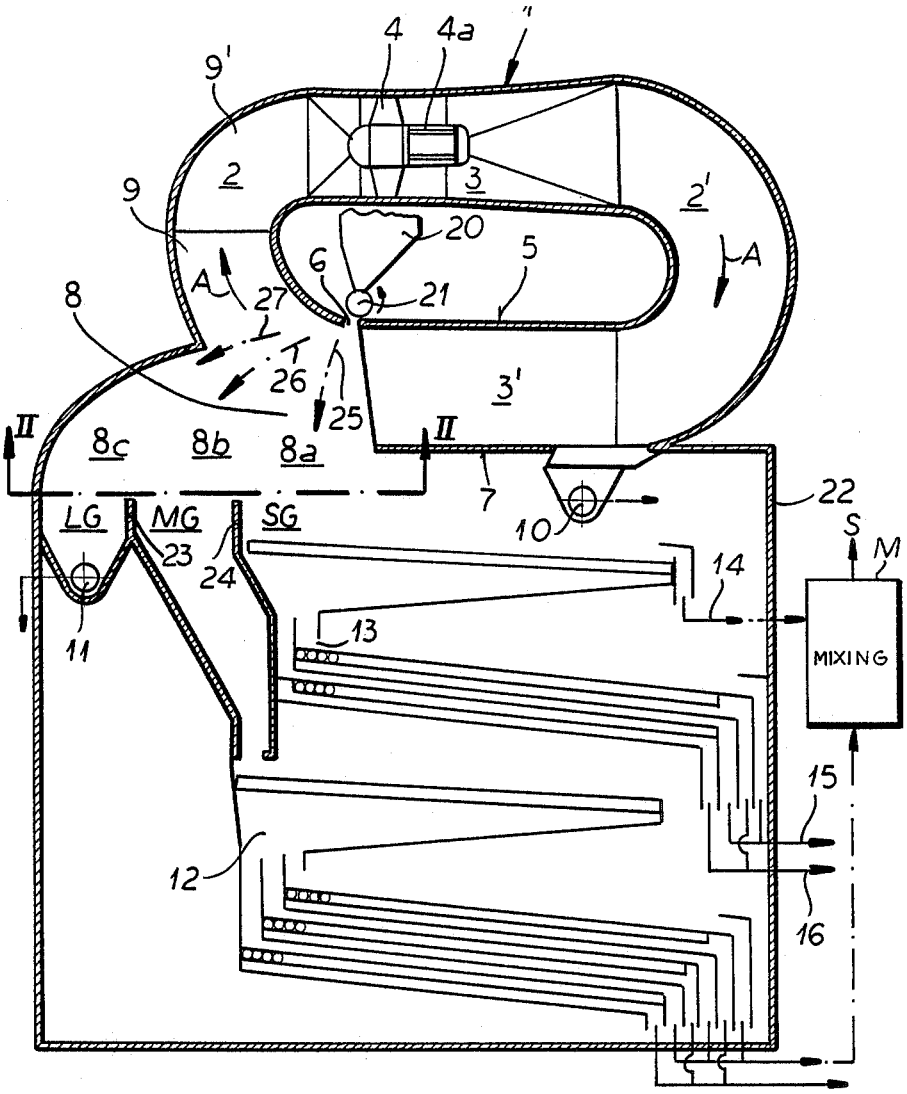
FIG. 1 is a highly diagrammatic vertical section through a presorting or preclassification apparatus in accordance with the present invention.
Figure 2:
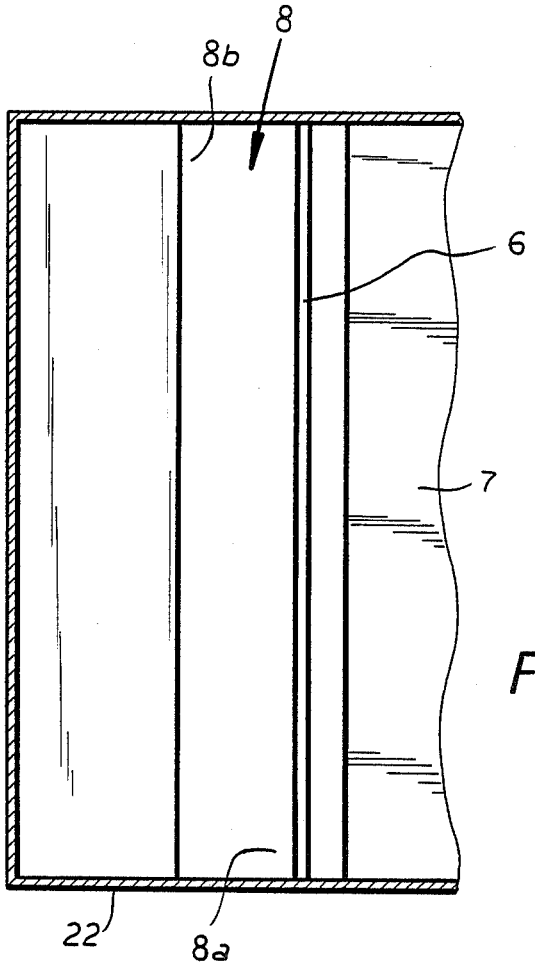
FIG. 2 is a cross-sectional view taken along the line II—II of FIG. 1.

The apparatus shown in FIG. 1 comprises an annular channel 1, which is composed of two opposite curved sections 2, 2' and two mutually opposite straight sections 3, 3'.

In the annular channel 1, an axial-flow blower 4 is mounted to circulate an air stream in the direction of the arrows A. The blower 4 is located at the downstream end of the curved section 2. It will be understood that instead of an axial blower 4 with its motor 4*a*, it is possible to use a cross-flow blower extending the full width of the annular channel.

The annular channel 1 has in its inner wall 5 an inlet slit 6 extending the full width of the annular channel. To dispense the seed materials through this inlet slit 6, a hopper 20 and a metering device 21 are provided.

In the absence of an air flow through the channel, therefore, a cascade of the raw seed materials would fall in a sheet flow from the slit across the cross section of the channel 1.

The inlet slit 6 is located immediately adjacent the upstream end of the curved section 2 which is subdivided into two segments 9 and 9' with different radii and centers of curvature. The curvature radii of the segment 9 is greater than those of the segment 9'.

At the end of the other curved section 2, a discharge device 10 is provided which can consist of a flap or other arrangement for abstracting a portion of the, circulating air stream so that the dust and chaff, i.e. the lightest fractions are removed. 7636-MR The housing 22 below the annular channel 1 and the outer wall 7 of the annular channel is formed with an outlet opening 8 which is divided by partitions 23 and 24 into opening zones 8*a*, 8*b* and 8*c* for the heavy fraction SG, the mixed intermediate fraction MG and the light fraction LG, respectively.

Because the air stream circulated in the annular channel 1 is directed transversely to the cascade of the raw seed materials, this cascade is fanned out as represented by the arrows 25, 26 and 27 to effect the preclassification previously described.

In operation, therefore, the air stream generated by the blower 4 describes at the region of the inlet slit for the raw seed materials to be separated, a curved path and each particle of the cascade is somewhat entrained by the air stream to fan out the cascade to a maximum degree. The individual particles thus fanned out, pass through the outlet opening by virtue of the action of gravity thereon and the particles then proceed in free-fall beyond this opening.

The fanned-out material is collected in three partial streams, LG, MG, SG, as described.

The light material is discharged by a discharge unit 11.

The mixed intermediate materials MG are subjected to the full gamut of seed-material processing, some of which has been represented by a multiple sifting and classification unit 12.

The heavy fraction SG can be used directly as good seed or can be provided with a moderate degree of sifting as represented at 13 with a coarse-particle discharge being shown at 14 and the good seed represented at 15 while the discharge of products passing through the sieve is represented at 16.

The circulating air, of course, entrains the lightest particles past the opening 8 and using the discharge unit 10, approximately 10% of this air is discharged continuously while 90% is recirculated through the blower. 10% make up or can be drawn into the annular channel 1. The separated air is cleaned in a cyclone and/or filter before being vented into the atmosphere and the makeup air can be drawn in partially through the opening 8*a* at which the heavy fraction is discharged.

As described, the good seed from the heavy fraction at 14 can be mixed with the good seed from the intermediate fraction MG in a mixer M to yield the seed product used at S.

I claim:

1. An apparatus for the treament of raw seed materials, comprising:

an annular channel formed in a vertical plane from a pair of opposite curved sections bridged by opposite straight sections;

a blower for circulating air through said channel received therein, said channel having an inner wall formed with an inlet slit across a width of said channel and an outer wall formed with an opening directly opposite said inlet slit at an upstream end of one of said curved sections;

means for introducing a cascade of said raw seed materials transversely into said inlet slit from above whereby said cascade of said materials is transversely fanned out by said air circulating in said channel; and means at said opening for collecting a heavy fraction, a mixed intermediate fraction and a light fraction from said materials, said one of said curved sections being fromed from two segments of different radii of curvature including a segment proximal to said inlet slit having larger radii of curvature than a segment distal from said inlet slit whereby the fanning out of the materials is enhanced.

2. The apparatus defined in claim 1 wherein said blower is located adjacent a downstream end of said one of said sections.

3. The apparatus defined in claim 2, further comprising means adjacent a downstream end of the other of said curved sections for removing from said channel a minor portion of the air circulating therein and light components including dust and chaff entrained therewith.

* * * * *